US012545386B2

(12) United States Patent
Takeshita

(10) Patent No.: US 12,545,386 B2
(45) Date of Patent: Feb. 10, 2026

(54) CONTROL APPARATUS AND CONTROL METHOD FOR OUTBOARD MOTOR

(71) Applicant: HONDA MOTOR CO., LTD., Tokyo (JP)

(72) Inventor: Toshiaki Takeshita, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 577 days.

(21) Appl. No.: 18/073,726

(22) Filed: Dec. 2, 2022

(65) Prior Publication Data

US 2023/0202631 A1 Jun. 29, 2023

(30) Foreign Application Priority Data

Dec. 28, 2021 (JP) ..... 2021-215072

(51) Int. Cl.

| | |
|---|---|
| ***B63H 20/10*** | (2006.01) |
| ***B63H 20/12*** | (2006.01) |
| ***B63H 23/16*** | (2006.01) |
| *B63H 20/00* | (2006.01) |

(52) U.S. Cl.

CPC ..... *B63H 20/10* (2013.01); *B63H 20/12* (2013.01); *B63H 2020/003* (2013.01); *B63H 23/16* (2013.01)

(58) Field of Classification Search

CPC ..... B63H 20/00; B63H 20/10; B63H 20/12; B63H 23/00; B63H 23/16; B63H 2020/003

USPC ..... 440/1

See application file for complete search history.

(56) References Cited

U.S. PATENT DOCUMENTS 11,347,223 B1 * 5/2022 Belter ..... B63H 20/08

FOREIGN PATENT DOCUMENTS

JP 2013-123954 A 6/2013
JP 2021181280 A * 11/2021

* cited by examiner

*Primary Examiner* — Lars A Olson
(74) *Attorney, Agent, or Firm* — Thomas| Horstemeyer, LLP

(57) ABSTRACT

A control apparatus for an outboard motor (4, 5) mounted on a hull (2), comprises a control unit (30, 40) that controls an attitude of the outboard motor (4, 5) with respect to the hull (2), and a detection unit (47, 49) that detects a counter electromotive force generated by an attitude change of the outboard motor (4, 5) due to an external force applied on the outboard motor (4, 5). The control unit (30, 40) determines that an object has collided with the outboard motor (4, 5) when the counter electromotive force that exceeds a predetermined threshold is detected.

10 Claims, 7 Drawing Sheets

CONTROL APPARATUS AND CONTROL METHOD FOR OUTBOARD MOTOR

CROSS-REFERENCE TO RELATED APPLICATION(S)

This application claims priority to and the benefit of Japanese Patent Application No. 2021-215072 filed on Dec. 28, 2021, the entire disclosure of which is incorporated herein by reference.

BACKGROUND OF THE INVENTION

Field of the Invention

The present invention relates to a control apparatus and a control method for an outboard motor.

Description of the Related Art

Japanese Patent Laid-Open No. 2013-123954 describes detecting the amount of change in the tilt angle of an outboard motor and determining that a collision has occurred when the detected change in the tilt angle reaches a predetermined amount of change.

Japanese Patent Laid-Open No. 2013-123954 does not describe a method of detecting the amount of change in the tilt angle of an outboard motor by a counter electromotive force.

SUMMARY OF THE INVENTION

The present invention has been made in consideration of the above described backgrounds and realizes techniques that can determine the collision of an object with a hull by the counter electromotive force generated by the change in the attitude of an outboard motor with respect to the hull due to an external force applied on the outboard motor, without the need to install a dedicated detector or other equipment.

In order to solve the above described backgrounds, according to the first aspect of the present invention, there is provided a control apparatus for an outboard motor (4, 5) mounted on a hull (2), comprising: a control unit (30, 40) that controls an attitude of the outboard motor (4, 5) with respect to the hull (2); and a detection unit (47, 49) that detects a counter electromotive force generated by an attitude change of the outboard motor (4, 5) due to an external force applied on the outboard motor (4, 5), wherein the control unit (30, 40) determines that an object has collided with the outboard motor (4, 5) when the counter electromotive force that exceeds a predetermined threshold is detected.

According to the second aspect of the present invention, in the first aspect, the control apparatus further comprises a speed detection unit (61) that detects a backward speed of the hull (2), wherein the control unit (30, 40) determines that an object has collided with the outboard motor (4, 5) when the counter electromotive force that exceed the predetermined threshold is detected while the hull (2) is moving backward.

According to the third aspect of the present invention, in the second aspect, the control unit (30, 40) stops a drive of the outboard motor (4, 5) when the control unit (30, 40) determines that an object has collided with the outboard motor (4, 5) when the backward speed of the hull (2) is not less than a predetermined speed.

According to the fourth aspect of the present invention, in the second aspect, the control unit (30, 40) issues a warning when the control unit (30, 40) determines that an object has collided with the outboard motor (4, 5) when the backward speed of the hull (2) is less than a predetermined speed.

According to the fifth aspect of the present invention, in the second aspect, the control unit (30, 40) stops a drive of the outboard motor (4, 5) when a collision energy of an object colliding with the outboard motor (4, 5) is not less than a predetermined even if the backward speed of the hull (2) is less than a predetermined speed.

According to the sixth aspect of the present invention, in the first aspect, the control unit (30, 40) controls a trim angle and a steering angle of the outboard motor (4, 5), and the detection unit (47, 49) detects the counter electromotive force generated by a variation of the trim angle and/or the steering angle of the outboard motor (4, 5) due to an external force applied on the outboard motor (4, 5).

According to the seventh aspect of the present invention, in the sixth aspect, the control unit (30, 40) determines that an object has collided with the outboard motor (4, 5) when at least one of the counter electromotive force generated by the variation of the trim angle of the outboard motor (4, 5) or the counter electromotive force generated by the variation of the steering angle of the outboard motor (4, 5) due to an external force applied on the outboard motor (4, 5) exceeds the predetermined threshold.

According to the eighth aspect of the present invention, in the first aspect, the control unit (30, 40) stores historical information that determines that an object has collided with the outboard motor (4, 5) and provides the historical information at a next boarding.

According to the ninth aspect of the present invention, in the first aspect, the counter electromotive force includes at least one of a current value or a voltage value.

According to the tenth aspect of the present invention, in the first aspect, the outboard motor (4, 5) includes a first outboard motor (4) and a second outboard motor (5), which are spaced apart in a width direction of the hull (2).

According to the eleventh aspect of the present invention, there is provided a method of controlling an outboard motor (4, 5) mounted on a hull (2), comprising: controlling an attitude of the outboard motor (4, 5) with respect to the hull (2); and detecting a counter electromotive force generated by a change in the attitude of the outboard motor (4, 5) due to an external force applied on the outboard motor (4, 5), wherein the controlling determines that an object has collided with the outboard motor (4, 5) when the counter electromotive force that exceeds a predetermined threshold is detected.

According to the present invention, the collision of an object can be determined by the counter electromotive force generated by the change in the attitude of an outboard motor with respect to the hull due to an external force applied on the outboard motor, without the need to install a dedicated detector or other equipment.

Specifically, according to first and eleventh aspects of the present invention, collision determination is performed using the counter electromotive force generated by an attitude change of outboard motors 4, 5, unlike prior art methods of detecting the tilt of an outboard motor, which cannot detect the tilt of an outboard motor unless the tilt of the outboard motor changes significantly due to an external force. Since the counter electromotive force can be detected even when the tilt of the first outboard motor 4 and/or the second outboard motor 5 does not change significantly, collision determination can be performed using the counter electromotive force generated by an attitude change of the first outboard motor 4 and/or the second outboard motor 5.

According to a second aspect of the present invention, collision of an object with a hull 2 during backward movement can be determined, which may assist the operator in visually confirming the object collision.

According to a third aspect of the present invention, if a determination that a collision has occurred is made when the backward speed of the hull 2 is not less than a predetermined speed, the drive of the outboard motors 4, 5 is stopped, so that when an object collides during high-speed backward movement, it can be dealt with quickly without waiting for the operator's operation.

According to a fourth aspect of the present invention, if a determination that a collision has occurred is made when the backward speed of the hull 2 is less than a predetermined speed, a warning is issued, so that when an object collides during low-speed backward movement, the operator can be made aware of the situation and encouraged to take an appropriate measure.

According to a fifth aspect of the present invention, even if the backward speed of the hull 2 is less than a predetermined speed, if the degree of collision at the time of collision determination is not less than a predetermined degree, the drive of the outboard motors 4, 5 is stopped, so even if an object collides during low-speed backward movement, when the damage caused by the object collision with the outboard motors 4, 5 is significant, it can be dealt with quickly without waiting for the operator's operation.

According to sixth and seventh aspects of the present invention, the counter electromotive force generated by the variation of the trim angle and/or steering angle of the outboard motors 4, 5 due to an external force applied on the outboard motors 4, 5 is detected, and when at least one of the counter electromotive force generated by the variation of the trim angle of the outboard motors 4, 5 or the counter electromotive force generated by the variation of the steering angle exceeds a predetermined threshold, a determination that a collision has occurred is made. Since the counter electromotive force is detected in response to an attitude change of the outboard motors 4, 5 in a plurality of directions during an object collision, this increases the accuracy of the determination and enhances safety. For example, even if only one of the trim angle or steering angle of the outboard motor varies during an object collision, it can be determined that a collision has occurred.

According to an eighth aspect of the present invention, it is possible to call attention to different operators.

According to a ninth embodiment of the present invention, it is possible to perform collision determination using a plurality of different detection values obtained from the counter electromotive force, so that determination accuracy is improved and safety can be improved.

According to a tenth aspect of the present invention, collision determination can be performed for each outboard motor in the event of object collision.

Further features of the present invention will become apparent from the following description of exemplary embodiments (with reference to the attached drawings).

DESCRIPTION OF THE EMBODIMENTS

Figure 1:
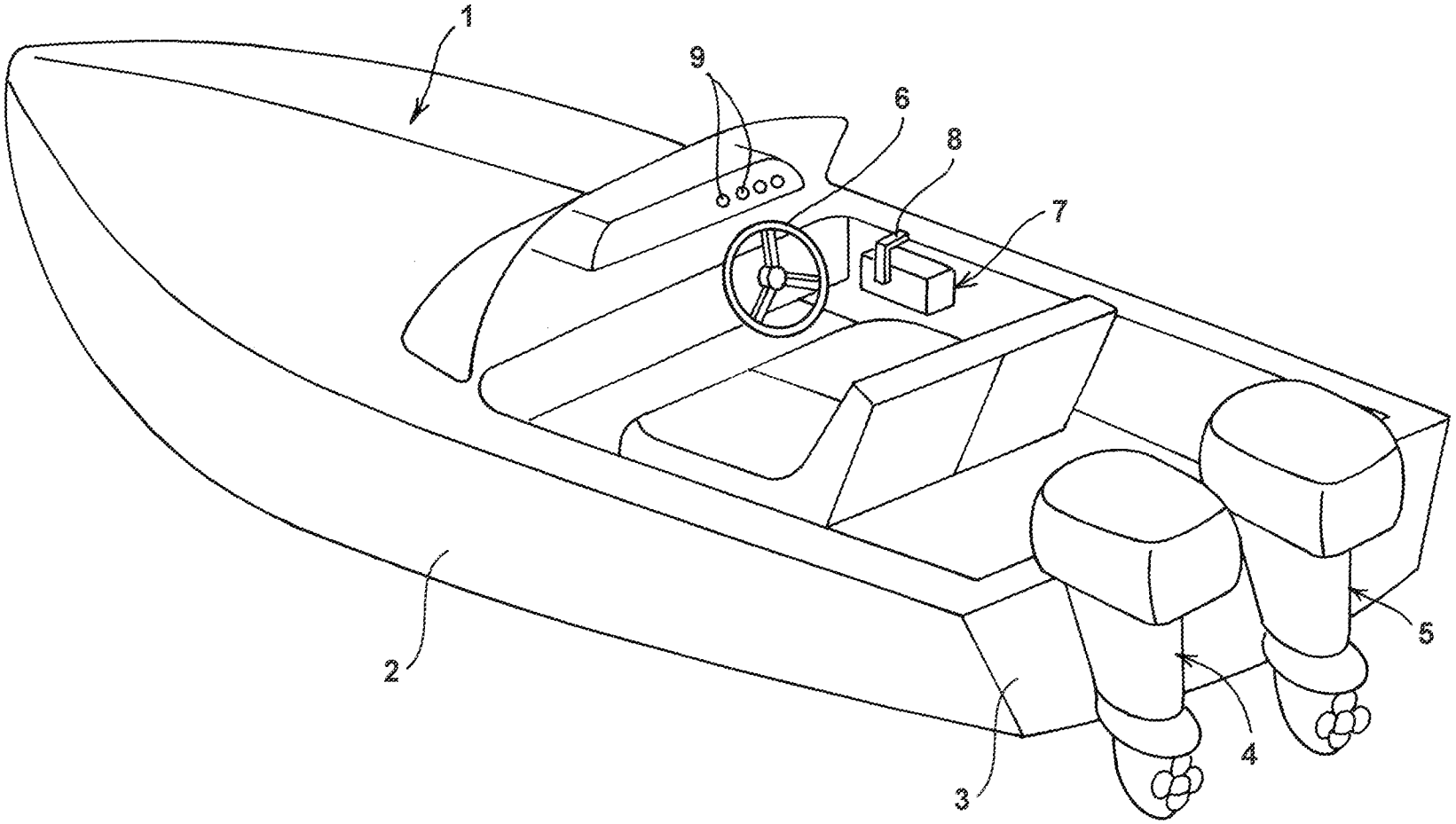
FIG. 1 is a perspective view of the external appearance and configuration of a vessel according to the present embodiment.

Hereinafter, embodiments will be described in detail with reference to the attached drawings. Note that the following embodiments are not intended to limit the scope of the claimed invention, and limitation is not made an invention that requires all combinations of features described in the embodiments. Two or more of the multiple features described in the embodiments may be combined as appropriate. Furthermore, the same reference numerals are given to the same or similar configurations, and redundant description thereof is omitted.

External Appearance and Configuration of Vessel 1

FIG. 1 is a perspective view of the external appearance and configuration of the vessel to which the control apparatus for the outboard motors of the present embodiment are applied.

As illustrated in FIG. 1, the vessel 1 includes a plurality of (for example, two) outboard motors (a first outboard motor 4 and a second outboard motor 5). The first outboard motor 4 and the second outboard motor 5 are mounted on a stern 3 of a hull 2. The first outboard motor 4 and the second outboard motor 5 are spaced apart by a predetermined distance in the width direction of the stern 3. The first outboard motor 4 is disposed on the port side of the stern 3. The second outboard motor 5 is disposed on the starboard side of the stern 3. The first outboard motor 4 and the second outboard motor 5 generate a propulsion to propel the hull 2.

A steering apparatus 6, a remote controller 7, and instruments 9 are provided near the steering seat of the hull 2. The steering apparatus 6 includes a steering wheel that allows the operator to control the turning direction of the hull 2. The remote controller 7 includes a shift lever 8 that allows the operator to adjust the speed of the hull 2 and switch between forward and backward movement of the hull 2. The instruments 9 include indicators that display the position, speed, and others of the vessel 1, and alarms that report abnormalities.

External Appearance and Configuration of Outboard Motor 4, 5

Figure 2:
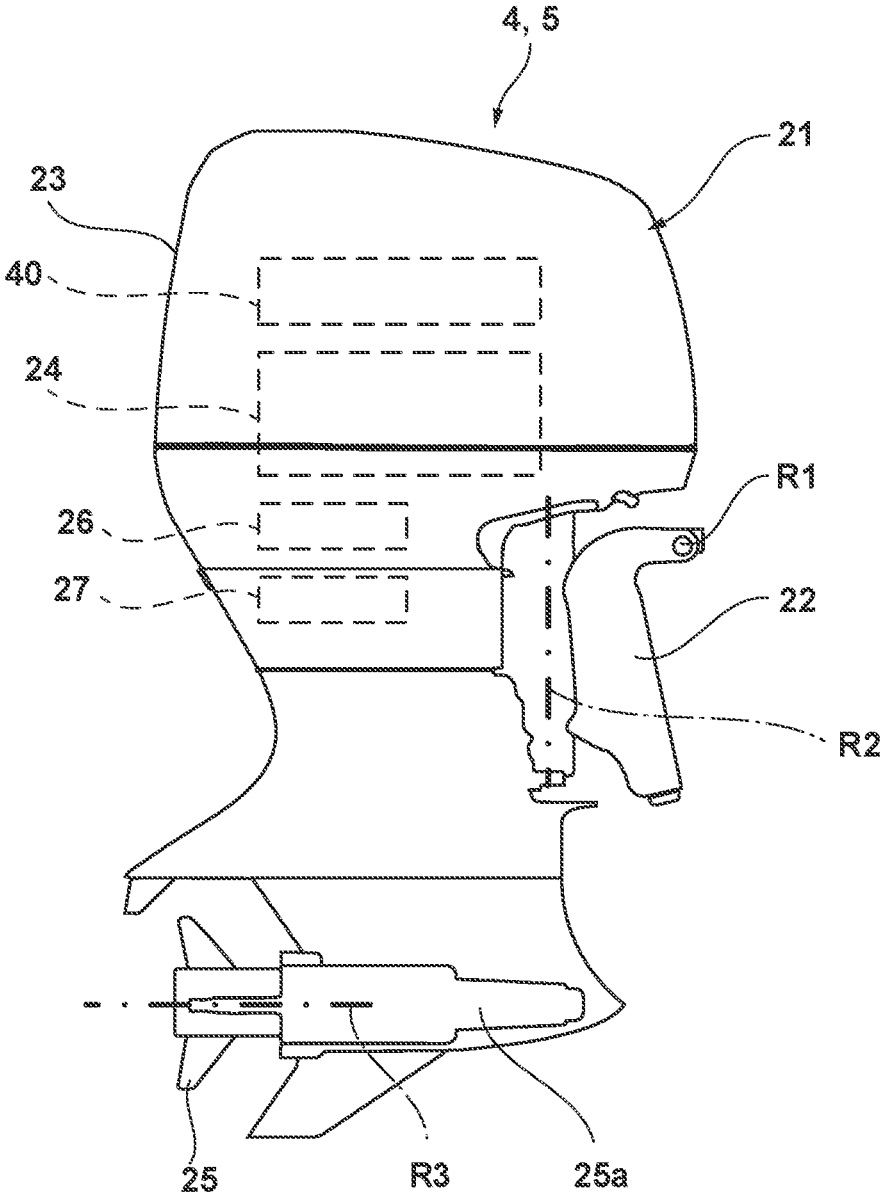
FIG. 2 is a side view of an outboard motor according to the present embodiment.

FIG. 2 is a side view of the first outboard motor 4 and the second outboard motor 5. The configuration of the first outboard motor 4 and the second outboard motor 5 are identical.

The first outboard motor 4 and the second outboard motor 5 include an outboard motor body 21 and a bracket 22. The outboard motor body 21 includes a cover member 23, a prime mover 24, a propeller 25, a steering actuator, and a trim actuator 27. The cover member 23 houses the prime mover 24. The prime mover 24 and the propeller 25 are connected by a power transmission mechanism (not illustrated), and the propeller 25 is rotated and driven by the driving force of the prime mover 24. The prime mover 24 is an engine or electric motor that drives the propeller 25.

The bracket 22 is a mounting mechanism for detachably attaching the first outboard motor 4 and the second outboard motor 5 to the stern 3. The first outboard motor 4 and the second outboard motor 5 are rotatably attached around a trim axis R1 of the bracket 22 by the trim actuator 27. By rotating the first outboard motor 4 and the second outboard motor 5 around the trim axis R1, the trim angle, which is the attitude of the first outboard motor 4 and the second outboard motor 5 in the pitching direction (trim direction) with respect to the hull 2, can be changed. The first outboard motor 4 and the second outboard motor 5 are attached by the steering actuator 26 to be rotatable around the steering axis R2 of the bracket 22. By rotating the first outboard motor 4 and the second outboard motor 5 around the steering axis R2, the steering (rudder) angle, which is the yaw direction (steering direction) attitude of the first outboard motor 4 and the second outboard motor 5 with respect to the hull 2, can be changed. Thus, by changing the trim angle and steering angle of the first outboard motor 4 and the second outboard motor 5, the attitude in the pitching direction and turning in the yaw direction of the hull 2 are controlled. The propeller 25 can rotate around the rotary axis R3 by the driving force transmitted from the prime mover 24 to the drive shaft 25*a*.

Control Configuration of Vessel 1

Figure 3:
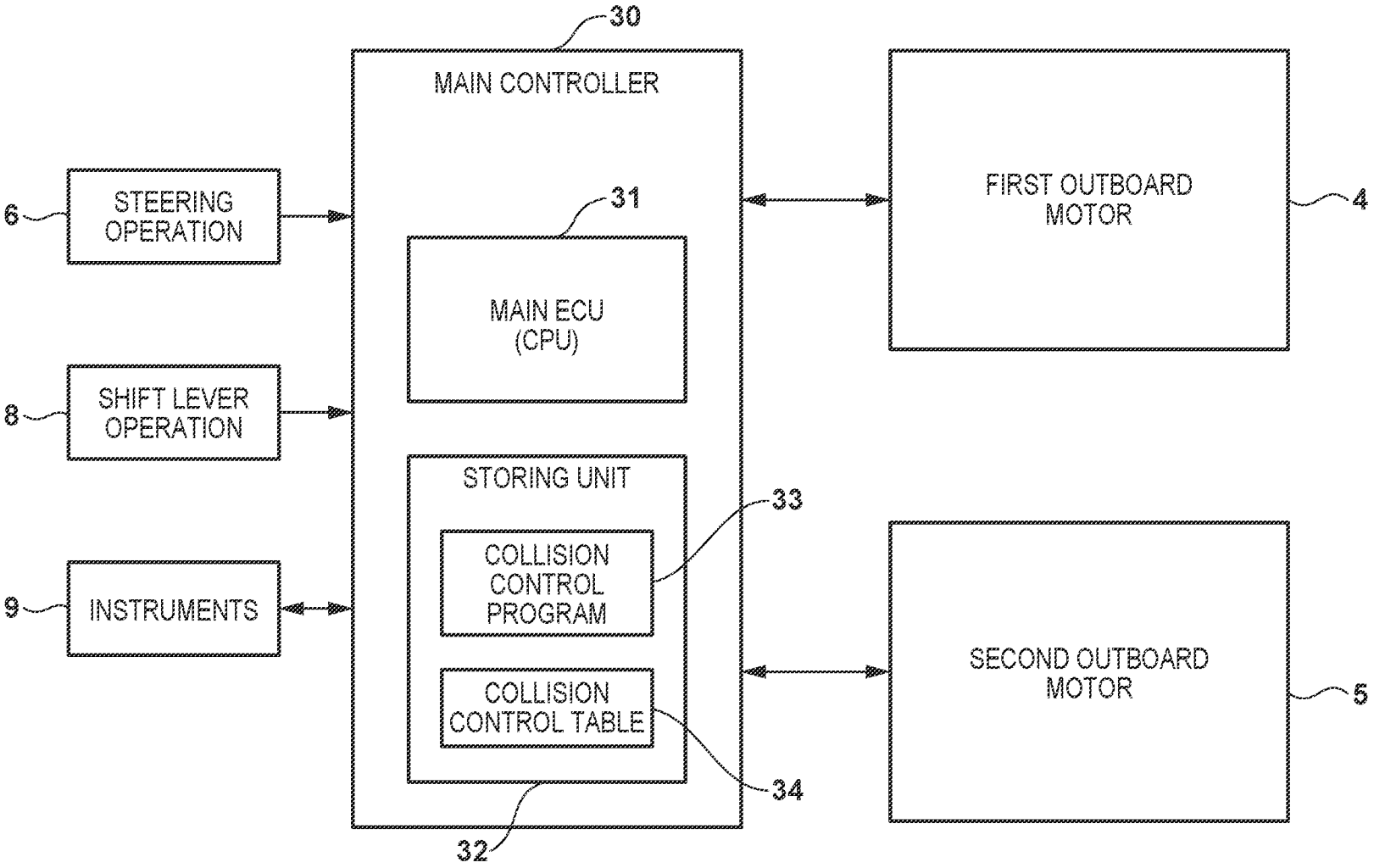
FIG. 3 is a block diagram illustrating the control configuration of a vessel according to the present embodiment.

FIG. 3 is a block diagram illustrating the control configuration of a vessel according to the present embodiment.

In the vessel 1 of the present embodiment, a main controller 30 controls the hull 2, the first outboard motor 4, the second outboard motor 5, and the instruments 9 based on the steering operation information of the steering apparatus 6 and the operation information of the shift lever 8 of the remote controller 7. The main controller 30 includes a main electronic control unit (ECU) 31 and a storing unit 32. The main ECU 31 includes a CPU and other components that control the hull 2, the first outboard motor 4, and the second outboard motor 5 by executing a control program stored in the storing unit 32. The storing unit 32 includes a memory that stores control programs and data tables executed by the main ECU 31. The control program executed by the main ECU 31 includes a collision control program described below, and the data tables referenced by the main ECU 31 executing the control program include the collision control tables referenced in the collision control program described below.

The main ECU 31 can control the first outboard motor 4 and the second outboard motor 5 independently.

Control Configuration of First Outboard Motor 4 and Second Outboard Motor 5

Figure 4:
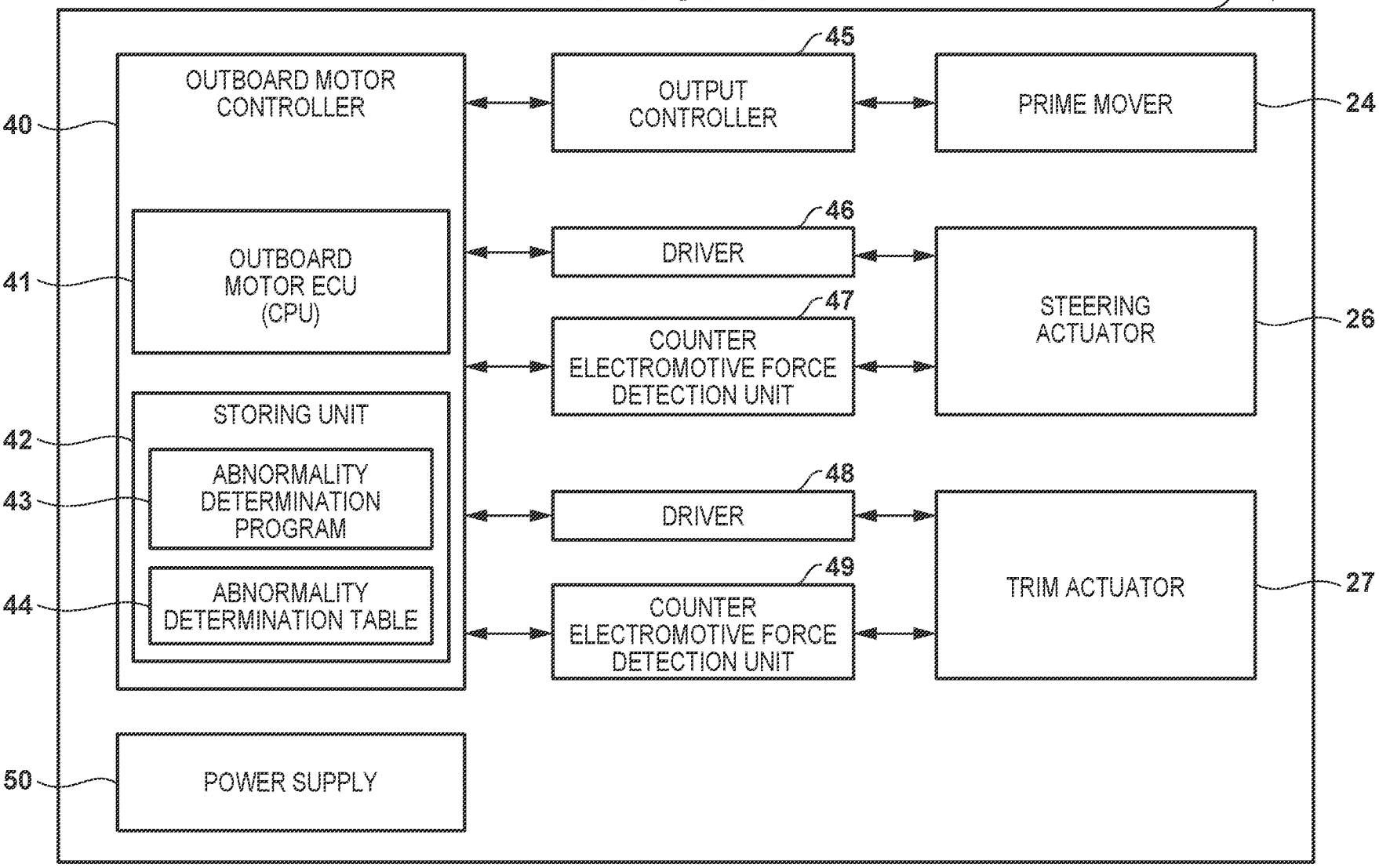
FIG. 4 is a block diagram illustrating the control configuration of an outboard motor according to the present embodiment.

FIG. 4 is a block diagram illustrating the control configuration of the first outboard motor 4 and the second outboard motor 5 according to the present embodiment. The control configuration of the first outboard motor 4 and the second outboard motor 5 are identical.

In the first outboard motor 4 and the second outboard motor 5 of the present embodiment, the outboard motor controller 40 controls the prime mover 24, the steering actuator 26, and the trim actuator 27 based on control information from the main controller 30. The outboard motor controller 40 includes an outboard motor electronic control unit (ECU) 41 and a storing unit 42. The outboard motor ECU 41 includes a CPU and other components that control the prime mover 24, the steering actuator 26, and the trim actuator 27 by executing a control program stored in the storing unit 42. The storing unit 42 includes a memory that stores control programs and data tables executed by the outboard motor ECU 41. The control program executed by the outboard motor ECU 41 includes an abnormality determination program 43 described below. The data tables referenced by the outboard motor ECU 41 executing the control program include the abnormality determination table 44 referenced in the abnormality determination program 43 described below.

The prime mover 24 is an engine or electric motor. The output controller 45 controls the output of the prime mover 24. When the prime mover 24 is an engine, the output controller 45 is a motor and a driver that adjusts the throttle valve opening. When the prime mover 24 is an electric motor, the output controller 45 is a driver that adjusts the power supplied to the motor.

The steering actuator 26 is a stepper motor that rotates the bracket 22 around the steering axis R2. The driver 46 is a circuit that drives the steering actuator 26 to rotate around the steering axis R2. The counter electromotive force detection unit 47 is a circuit that detects the counter electromotive force (current and/or voltage) generated in the steering actuator 26 due to the rotation of the first outboard motor 4 or the second outboard motor 5 around the steering axis R2 by an external force.

The trim actuator 27 is a stepper motor that rotates the bracket 22 around the trim axis R1. The driver 48 is a circuit that drives and rotates the trim actuator 27 around the trim axis R1. The counter electromotive force detection unit 49 is a circuit that detects the counter electromotive force (current and/or voltage) generated in the trim actuator 27 due to the rotation of the first outboard motor 4 and/or the second outboard motor 5 around the trim axis R1 by an external force.

The counter electromotive force is the power induced in the stator winding (self-inductance) as the rotor rotates.

A power supply 50 is a battery that supplies power to the components of the first outboard motor 4 and the second outboard motor 5.

Collision Determination and Collision Control

Next, the collision determination and collision control of the present embodiment will be described with reference to FIGS. 5 to 7.

The collision control of the present embodiment is the control when it is determined that the first outboard motor 4 and the second outboard motor 5 have collided with some object.

Figure 5:
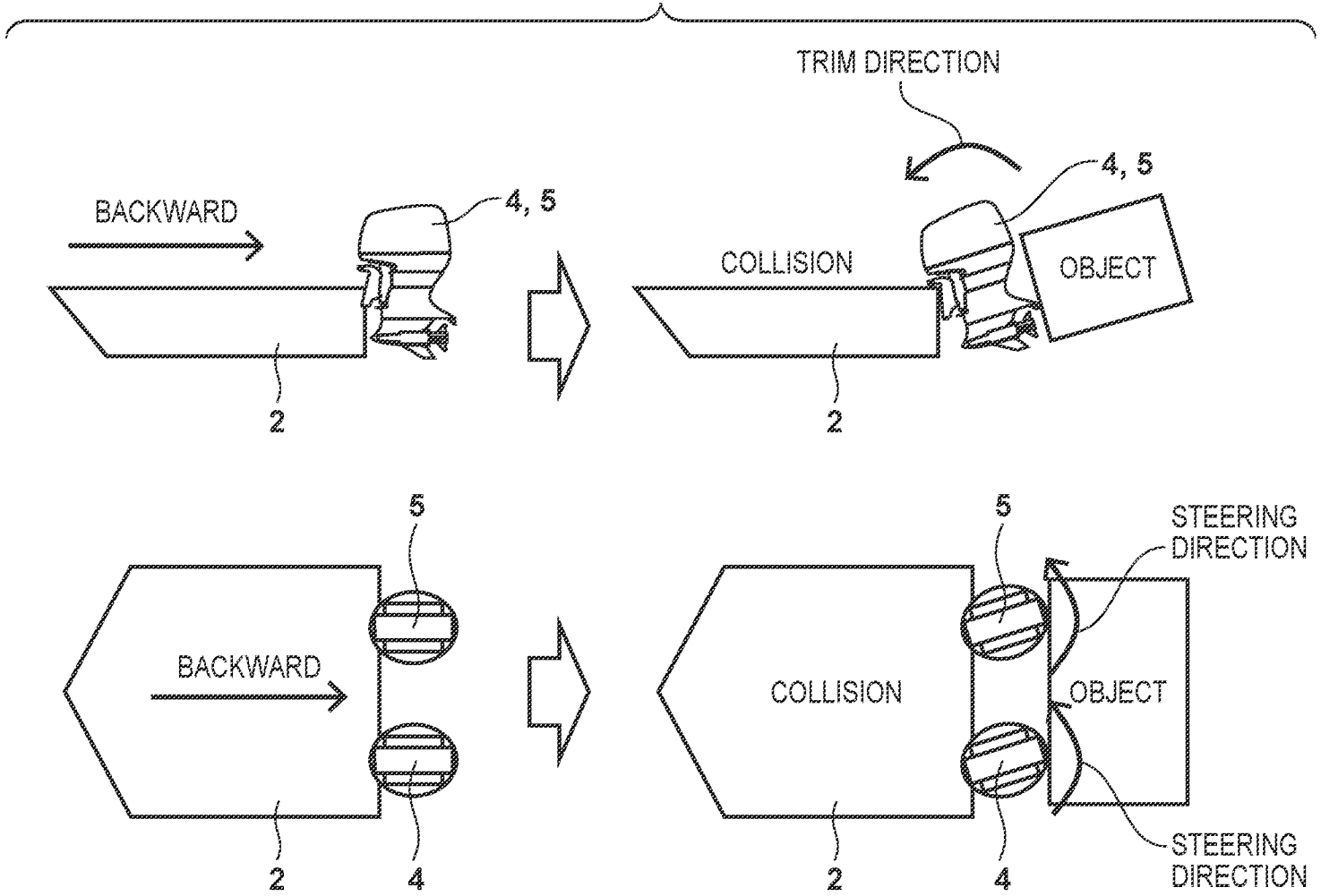
FIG. 5 is a diagram illustrating a collision determination method according to the present embodiment.

FIG. 5 is a diagram illustrating a collision determination method according to the present embodiment.

When the first outboard motor 4 and/or the second outboard motor 5 collides with some object when the hull 2 is moving backward, as illustrated in FIG. 5, it can be assumed that the first outboard motor 4 and/or the second outboard motor 5 is forced by an external force to change its attitude in the pitching or yaw direction or rotate around the trim axis R1 or the steering axis R2.

When the first outboard motor 4 and/or the second outboard motor 5 is forced by an external force to rotate around the trim axis R1 or the steering axis R2, a counter electromotive force is generated in the trim actuator 27 or the steering actuator 26, respectively.

This may occur during backward movement, whether the vessel is going straight or turning.

The collision determination of the present embodiment determines whether or not the hull 2 has collided with some object based on the speed of the hull 2 when moving backward, the counter electromotive force (current and/or voltage) generated in the trim actuator 27 of the first outboard motor 4 and/or the second outboard motor 5, and the counter electromotive force (current and/or voltage) generated in the steering actuator 26.

The collision determination method according to the present embodiment includes detecting a change in the current or voltage value (waveform) with respect to the driving power (current or voltage) of the steering actuator 26 and/or the trim actuator 27 due to the counter electromotive force of the steering actuator 26 and/or the trim actuator 27 caused by the torque applied during object collision when, for example, the backward speed of the hull 2 is not less than a predetermined speed.

The determination that a collision has occurred is then made based on either the backward speed of the hull 2 and the change in the current or voltage value of the steering actuator 26, or the backward speed of the hull 2 and the change in the current or voltage value of the trim actuator 27, or the backward speed of the hull 2 and the change in the current or voltage value of the steering actuator 26 and the trim actuator 27.

Thus, collision determination can be performed using a plurality of different detected values obtained from the counter electromotive force, this increases the accuracy of the determination and enhances safety.

When a determination that a collision has occurred is made, the collision control of the present embodiment then issues a warning or stop the outboard motor drive in order to reduce the impact on the outboard motors, electrical system, and others.

Figure 6:
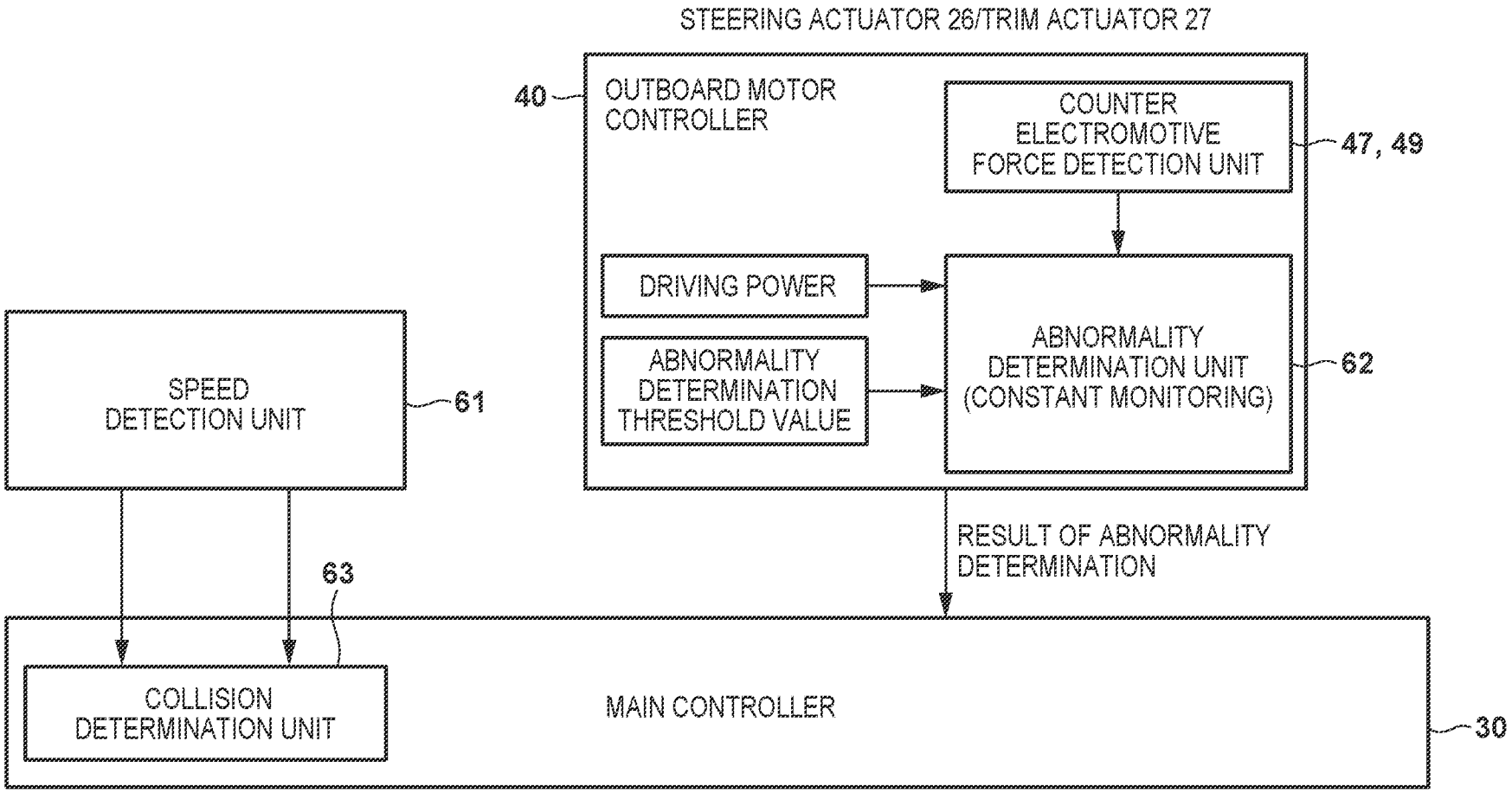
FIG. 6 is a diagram illustrating the control configuration for performing a collision determination according to the present embodiment.

FIG. 6 is a diagram illustrating the control configuration for performing a collision determination according to the present embodiment.

The collision determination of the present embodiment is realized by a collision control program 33 and a collision control table 34 executed by the main ECU 31, an abnormality determination program 43 and an abnormality determination table 44 executed by the outboard motor ECU 41, the counter electromotive force detection units 47 and 49, a speed detection unit 61, an abnormality determination unit 62, and a collision determination unit 63. The abnormality determination unit 62 is a functional block of the ECU 41 of the outboard motor controller 40. The collision determination unit 63 is a functional block of the ECU 31 of the main controller 30.

The speed detection unit 61 detects the speed of the hull 2 when moving backward.

The abnormality determination unit 62 detects a change in the current or voltage value (waveform) with respect to the driving power (current or voltage) of the steering actuator 26 and/or the trim actuator 27 caused by the counter electromotive force of the steering actuator 26 and/or the trim actuator 27 due to the torque applied during object collision. The abnormality determination unit 62 then determines the abnormality of the steering actuator 26 and the trim actuator 27 of the first outboard motor 4 and the second outboard motor 5 by comparing the current or voltage value due to the counter electromotive force of the steering actuator 26 and trim actuator 27 of the first outboard motor 4 and the second outboard motor 5 with the threshold value. The threshold values for determining abnormality are stored in an abnormality determination table 44 in the storing unit 42 of the outboard motor controller 40.

The collision determination unit 63 performs collision determination based on the backward speed of the hull 2, the result of the abnormality determination for the actuator of the first outboard motor 4, and the result of the abnormality determination for the actuator of the second outboard motor 5.

The collision determination unit 63 determines that a collision has occurred, for example, when any one of the following conditions (1) to (3) is satisfied:

(1) the backward speed of the hull 2 is not less than a threshold value and the actuator of the first outboard motor 4 is determined to be abnormal;

(2) the backward speed of the hull 2 is not less than the threshold value and the actuator of the second outboard motor 5 is determined to be abnormal;

(3) the backward speed of the hull 2 is not less than the threshold value and the actuators of the first outboard motor 4 and the second outboard motor 5 are determined to be abnormal.

The main ECU 31 may store the historical information at the time of collision determination in the storing unit 42 and provide the information by the instruments 9 at the next boarding. This can alert different operators.

In addition, the main ECU 31 performs, for example, any one of the following collision control operations (4) to (6) at the time of collision determination:

(4) stops the drive of the first outboard motor 4 and the second outboard motor 5 when the backward speed of the hull 2 is not less than a predetermined speed;

(5) issues a warning when the backward speed of the hull 2 is less than a predetermined speed; and (6) stops the drive of the first outboard motor 4 and the second outboard motor 5 when the degree of object collision is not less than a predetermined degree even if the backward speed of the hull 2 is less than a predetermined speed.

The degree of object collision is, for example, the amount of change in the current or voltage value of the steering actuator 26 detected by the counter electromotive force detection unit 47, the amount of change in the current or voltage value of the trim actuator 27 detected by the counter electromotive force detection unit 49, and the collision energy determined from the backward speed and weight of the hull 2 at the time of collision determination.

The collision control table 34 in the storing unit 32 of the main controller 30 contains information on the threshold of the backward speed of the hull 2 for the ECU 31 to refer to during collision determination and control information to refer to during collision control. In addition, information such as threshold values for the current or voltage values of the steering actuator 26 and the trim actuator 27 for reference at the time of abnormality determination and control information for reference at the time of abnormality determination are registered in the abnormality determination table 44 in the storing unit 42 of the outboard motor controller 40. The collision control table 34 and the abnormality determination table 44 are generated in advance through collision experiments.

Control Flow

Figure 7:
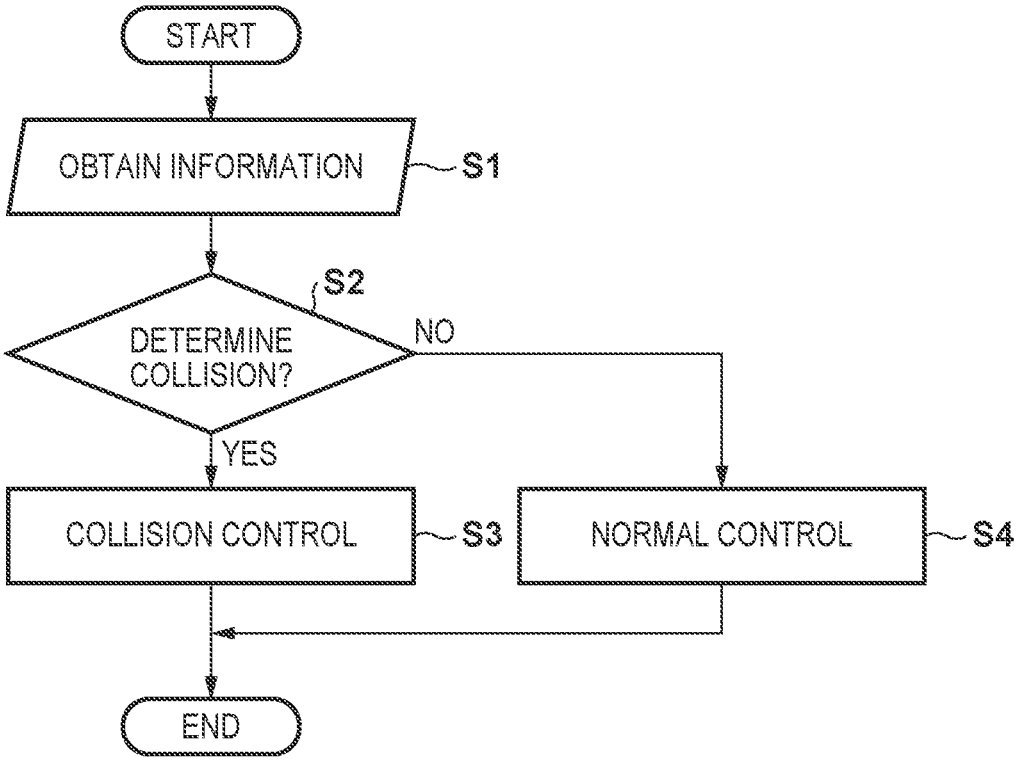
FIG. 7 is a flowchart illustrating a collision control according to the present embodiment.

FIG. 7 is a flowchart illustrating the collision control according to the present embodiment.

In FIG. 7, in step S1, the main ECU 31 obtains information from the speed detection unit 61, and the outboard motor ECU 41 obtains information from the counter electromotive force detection units 47, 49.

In step S2, the outboard motor ECU 41 performs abnormality determination based on the information obtained in step S1. The main ECU 31 performs collision determination based on the information obtained in step S1 and the result of the abnormality determination obtained from the outboard motor ECU 41. When the main ECU 31 determines that a collision has occurred, the processing proceeds to step S3 to perform collision control, and when the main ECU 31 determines that no collision has occurred, the processing proceeds to step S4 to perform normal control.

In step S3, the ECU 31 performs collision control according to the collision control program 33.

In step S4, the ECU 31 controls the system according to a normal control program.

In the embodiment described above, collision determination and collision control are performed by the main ECU 31 of the main controller 30, and abnormality determination is performed by the ECU 41 of the outboard motor controller 40 of each of the first outboard motor 4 and the second outboard motor 5. The abnormality determination, collision determination, and collision control may be performed by the ECU 41 of the outboard motor controller 40 of each of the first outboard motor 4 and the second outboard motor 5.

As described above, according to the present embodiment, without the need for a dedicated detector or other equipment, the collision of an object can be determined by the counter electromotive force generated by the change in the attitude of the first outboard motor 4 and/or the second outboard motor 5 due to an external force applied on the first outboard motor 4 and/or the second outboard motor 5.

In particular, in the prior art method of detecting the tilt of an outboard motor, the tilt of the outboard motor cannot be detected unless the tilt of the outboard motor changes significantly due to an external force, but the present embodiment uses the counter electromotive force generated by an attitude change of the first outboard motor 4 and/or the second outboard motor 5 to perform collision determination. Since the counter electromotive force can be detected even when the tilt of the first outboard motor 4 and/or the second outboard motor 5 does not change significantly, collision determination can be performed using the counter electromotive force generated by an attitude change of the first outboard motor 4 and/or the second outboard motor 5.

In addition, the collision of an object with the hull 2 during backward movement can be determined, which can assist the operator in visually confirming object collision.

If a collision is determined when the backward speed of the hull 2 is not less than a predetermined speed, the drive of the first outboard motor 4 and/or the second outboard motor 5 is stopped, so that when an object collides during high-speed backward movement, it can be dealt with quickly without waiting for the operator's operation.

If a collision is determined when the backward speed of the hull 2 is less than a predetermined speed, a warning is issued, so that if an object collides during low-speed backward movement, the operator can be made aware of the situation and encouraged to take appropriate action.

Even if the backward speed of the hull 2 is less than a predetermined speed, if the degree of collision at the time of collision determination is not less than a predetermined degree, the drive of the first outboard motor 4 and/or the second outboard motor 5 is stopped, so even if an object collides during low-speed backward movement, when the damage caused by the object collision with the outboard motors is significant, it can be dealt with quickly without waiting for the operator's operation.

In addition, the counter electromotive force generated by the variation of the trim angle and/or steering angle of the first outboard motor 4 and/or the second outboard motor 5 due to an external force applied on the first outboard motor 4 and/or the second outboard motor 5 is detected, and a determination that a collision has occurred is made when at least one of the counter electromotive force generated by the variation of the trim angle of the first outboard motor 4 and/or the second outboard motor 5 or the counter electromotive force generated by the variation of the steering angle exceeds a predetermined threshold value.

Thus, since the counter electromotive force corresponding to changes in the attitude of the first outboard motor 4 and/or the second outboard motor 5 in a plurality of directions during an object collision is detected, which increases the accuracy of the determination and enhances safety. For example, even if only one of the trim angle or steering angle of the outboard motor varies during an object collision, it can be determined that a collision has occurred.

In addition, the main ECU 31 may store the historical information at the time of collision determination and provide the information at the next boarding to alert different operators.

The counter electromotive force includes at least one of the current and voltage values, and since collision determination can be performed using a plurality of different detected values obtained from the counter electromotive force, this increases the accuracy of the determination and enhances safety.

In addition, it will be possible to perform collision determination for each of the outboard motors 4, 5 at the time of an object collision.

The invention is not limited to the foregoing embodiments, and various variations/changes are possible within the spirit of the invention.

For example, the present embodiment includes two outboard motors, but the number of outboard motors is not limited to two and may be one or three or more.

In the present invention, a computer program corresponding to the control of outboard motors of the above described embodiment or a storage medium containing the computer program may be supplied to a computer controlling the hull 2 and the outboard motors 4, 5, so that the computer reads and executes the program code stored in the storage medium.

What is claimed is:

1. A control apparatus for an outboard motor (4, 5) mounted on a hull (2), comprising:

a control unit (30, 40) that controls an attitude of the outboard motor (4, 5) with respect to the hull (2);

an actuator (26, 27) that is controlled by the control unit (30, 40), and a detection unit (47, 49) that detects a counter electromotive force generated when the actuator (26, 27) is forcibly operated due to the outboard motor (4, 5) being subjected to an external force, wherein the control unit (30, 40) determines that an object has collided with the outboard motor (4, 5) when a change in current value or voltage value with respect to a driving power for the actuator (26, 27) caused by the counter electromotive force exceeds a predetermined threshold.

2. The apparatus according to claim 1, further comprising a speed detection unit (61) that detects a backward speed of the hull (2), wherein the control unit (30, 40) determines that an object has collided with the outboard motor (4, 5) when the change in current value or voltage value with respect to the driving power for the actuator (26, 27) caused by the counter electromotive force exceeds the predetermined threshold while the hull (2) is moving backward.

3. The apparatus according to claim 2, wherein the control unit (30, 40) stops a drive of the outboard motor (4, 5) when the control unit (30, 40) determines that an object has collided with the outboard motor (4, 5) when the backward speed of the hull (2) is not less than a predetermined speed.

4. The apparatus according to claim 2, wherein the control unit (30, 40) issues a warning when the control unit (30, 40) determines that an object has collided with the outboard motor (4, 5) when the backward speed of the hull (2) is less than a predetermined speed.

5. The apparatus according to claim 2, wherein the control unit (30, 40) stops a drive of the outboard motor (4, 5) when a collision energy of an object colliding with the outboard motor (4, 5) is not less than a predetermined even if the backward speed of the hull (2) is less than a predetermined speed.

6. The apparatus according to claim 1, wherein the control unit (30, 40) controls a trim angle and a steering angle of the outboard motor (4, 5), and the detection unit (47, 49) detects the counter electromotive force generated by a variation of the trim angle and/or the steering angle of the outboard motor (4, 5) due to the outboard motor (4, 5) being subjected to an external force.

7. The apparatus according to claim 6, wherein the control unit (30, 40) determines that an object has collided with the outboard motor (4, 5) when the change in current value or voltage value caused by the counter electromotive force generated by the variation of the trim angle of the outboard motor (4, 5) and/or the counter electromotive force generated by the variation of the steering angle of the outboard motor (4, 5) due to the outboard motor (4, 5) being subjected to an external force exceeds the predetermined threshold.

8. The apparatus according to claim 1, wherein the control unit (30, 40) stores historical information that determines that an object has collided with the outboard motor (4, 5) and provides the historical information at a next boarding.

9. The apparatus according to claim 1, wherein the outboard motor (4, 5) includes a first outboard motor (4) and a second outboard motor (5), which are spaced apart in a width direction of the hull (2).

10. A method of controlling an outboard motor (4, 5) mounted on a hull (2), comprising:

controlling an actuator (26, 27) and an attitude of the outboard motor (4, 5) with respect to the hull (2); and detecting a counter electromotive force generated when the actuator (26, 27) is forcibly operated due to the outboard motor (4, 5) being subjected to an external force, wherein the controlling determines that an object has collided with the outboard motor (4, 5) when a change in current value or voltage value with respect to a driving power for the actuator (26, 27) caused by the counter electromotive force exceeds a predetermined threshold.

* * * * *